United States Patent [19]

Poffenbarger

[11] 4,426,642

[45] Jan. 17, 1984

[54] MINE ALERT DEVICE

[75] Inventor: Perry S. Poffenbarger, Charleston, W. Va.

[73] Assignees: John Wade Bell, Webster Springs; Harold R. Haynes, Charleston, both of W. Va. ; part interest to each

[21] Appl. No.: 309,404

[22] Filed: Oct. 7, 1981

[51] Int. Cl.[3] ..... G08B 21/00

[52] U.S. Cl. ..... 340/690; 33/1 H; 73/784; 340/540; 340/666; 340/686

[58] Field of Search ..... 340/690, 686, 666, 540; 73/784; 33/1 H

[56] References Cited

U.S. PATENT DOCUMENTS

| | | | |
|---|---|---|---|
| 1,108,328 | 2/1912 | Lee . | |
| 1,737,514 | 11/1929 | Nikolish . | |
| 2,692,924 | 10/1954 | Williams et al. . | |
| 3,058,341 | 10/1962 | Heintzmann | 73/784 |
| 3,111,655 | 11/1963 | Kotarsky . | |
| 3,341,843 | 9/1967 | Walsh . | |
| 3,594,773 | 7/1971 | Conkle . | |
| 3,786,503 | 1/1974 | Webb et al. . | |
| 3,826,128 | 7/1974 | McVey et al. . | |
| 4,097,854 | 6/1978 | Black et al. . | |
| 4,136,556 | 1/1979 | Graham . | |
| 4,156,236 | 5/1979 | Conkle . | |

*Primary Examiner*—Glen R. Swann, III

*Attorney, Agent, or Firm*—Cushman, Darby & Cushman

[57] ABSTRACT

A device for alerting miners of an unsafe condition existing in mine shafts includes a surface-engaging member, a chamber-defining member having a compressible medium therein, and a plunger connected between the surface-engaging member and chamber-defining member. The plunger is slidably engaged with the chamber at one end in contact with the compressible medium therein so that the plunger moves in response to a compression force applied to the surface engaging member and applies pressure on the compressible medium. A switch for actuating an alarm in response to a predetermined amount of movement between the surface-engaging member and the chamber-defining member, is provided and a visual indicator operatively associated with the compressible medium is utilized so as to set the switch to establish the predetermined amount of movement necessary to actuate the alarm.

16 Claims, 3 Drawing Figures

Fig. 2
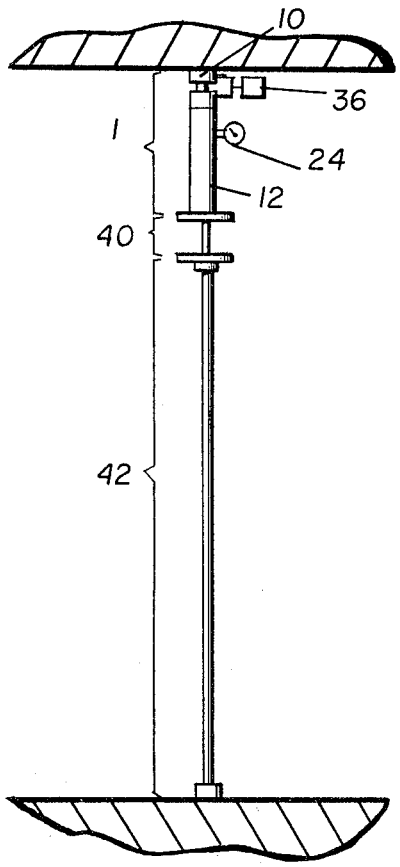
Fig. 1
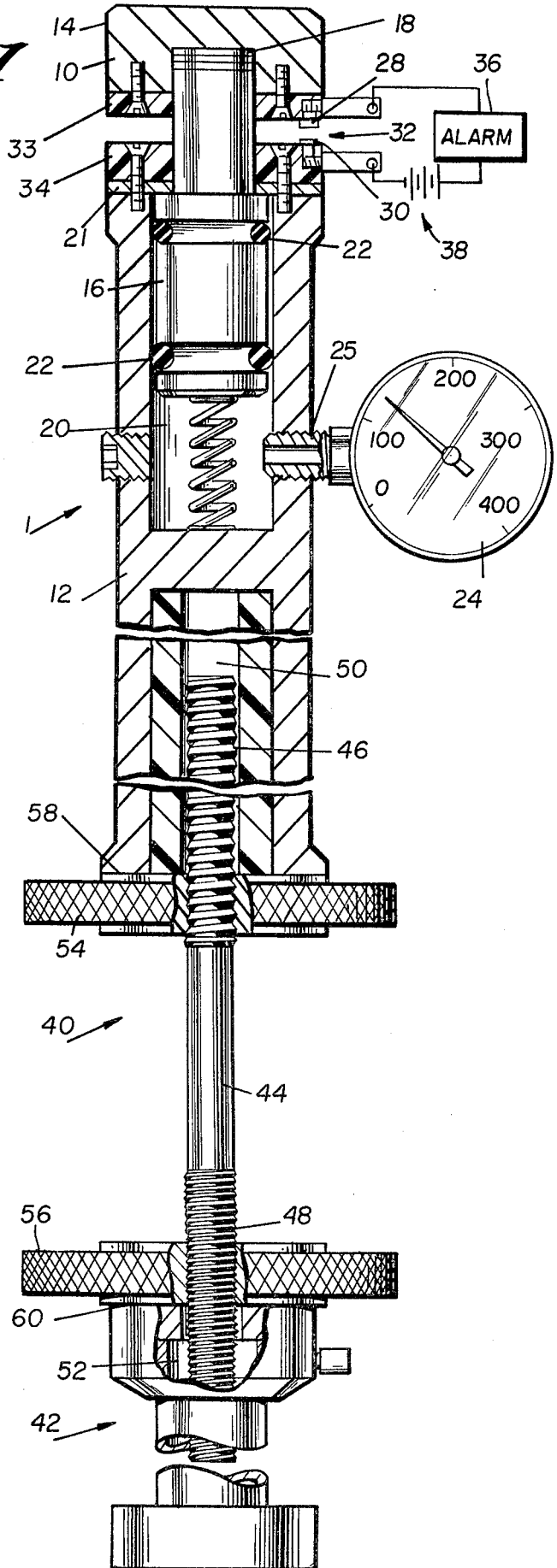
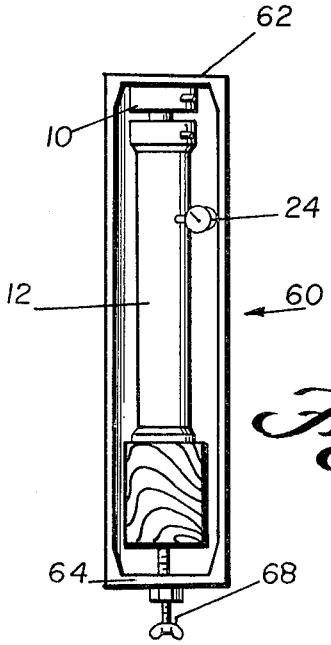
Fig. 3

MINE ALERT DEVICE

BACKGROUND AND SUMMARY OF THE INVENTION

The present invention generally relates to a device for warning miners of an unsafe condition existing in mine shafts. More particularly, the present invention relates to an easily and accurately settable device for actuating an alarm system in response to predetermined amounts of movement of the mine ceiling thereby enabling miners to escape the potential danger of a mine shaft collapse.

Devices which alert miners to potential ceiling collapses in underground mines are not new. Indeed, the art is replete with various devices for warning miners of a potential mine collapse, as evidenced by U.S. Pat. Nos. 1,018,328; 1,737,514; 2,692,924; 3,111,655; 3,341,843; 3,594,773; 3,786,503; 3,826,128; 4,097,854; 4,136,556; and 4,156,236. However, a distinct problem associated with these prior mine alert devices is that they are rather complicated to properly position and accurately set in the mine. Additionally, conventional mine alert devices often require engineering supervision or an inordinant amount of technical training to properly install these devices in mine shafts.

However, according to the present invention, there is provided a relatively simple, compact, yet rugged device which can be accurately and reliably set to a predetermined set point with little technical training by the person installing the device. A predetermined variance or movement in the ceiling of the mine shaft will cause the device to actuate an alarm. According to the present invention, therefore, there is provided a device which will warn miners in an underground mine of a potential hazard existing in the mine shaft so that they may seek safety.

The device according to the present invention utilizes a visual indication to accurately set the device so that an alarm will actuate when a predetermined amount of movement is detected in the mine shaft ceiling. The present device contemplates that a set point will be pre-established prior to installation of the device in the mine shaft.

To pre-establish the set point, a mining engineer need only determine the amount of earth movement which would constitute potential hazard. The mining engineer or the like will thus translate this quantum amount of earth movement into the proper set point on the apparatus which is preferably determined by a gap between two opposing electrical contacts or the like. The gap set point of the present device correlates directly into a visual indication, such as, for example, a pressure indication on a pressure gauge. The gap set point is accurately measured by conventional means, such as feeler gauges or the like, and the corresponding visual indication is adequately noted. Thus, all that a person installing the present device need to effect is a reproduction of the noted visual indication in order to accurately set the gap in the predetermined manner. Thus, installing the present device in the mine shaft does not require any technical training or assistance.

Other objects and advantages of the present invention will become more readily understood to the reader upon consideration of the following detailed description of the preferred exemplary embodiment together with reference to the accompanying drawing.

BRIEF DESCRIPTION OF THE DRAWING

FIG. 1 is a cross-sectional elevational view of an exemplary embodiment according to the present invention;

FIG. 2 is an elevational view of the embodiment depicted in FIG. 1 showing the device positioned between the floor and ceiling of a mine shaft; and FIG. 3 is a plan view of a unit utilized to selectively pre-establish the electrical contact gap according to the device of the present invention.

DETAILED DESCRIPTION OF THE PREFERRED EXEMPLARY EMBODIMENT ACCORDING TO THE PRESENT INVENTION

Referring more specifically to the drawing wherein like numerals refer to like structures throughout the various Figures, it will be seen by referring to FIG. 1 that the device 1 according to the present invention generally comprises a cap assembly 10, body member 12 and plunger 16 connected between cap member 10 and body member 12.

The device according to the present invention is intended to be positioned between the floor and ceiling of an underground mine as can be more clearly seen in FIG. 2. Generally, the depicted exemplary embodiment is contemplated as having three component structures. The first component is the mine alert device 1 according to the present invention as discussed in detail above. The second element is a spreader 40 and the third element is a support member 42. As can be seen in FIG. 2, the spreader 40 and support member 42 are axially positioned with respect to the mine alert device 1 when properly installed in an underground mine.

Referring to FIG. 1, the spreader 40 generally comprises an elongated shaft 44 having threaded end portions 46, 48. Shaft 44 is accepted within cavity 50 defined by body member 12 at the lower portion thereof. End portion 48 is similarly received in a lower cavity 52 defined by support member 42. In such a manner, the spreader 40 is axially positioned between support member 42 and body member 12.

Cooperating with the threaded end portions 46, 48 of spreader shaft 44, there are provided adjusting wheels 54, 56. Adjusting wheel 54 threadingly engages upon end portion 46 and defines a surface 58 upon which the lower portion of body member 12 rests. Similarly, adjusting wheel 56 is threadingly engaged with threaded end portion 48 and defines a surface 60 with which rests on the top portion of support member 42. Thus, it should be appreciated that a turning movement applied to either adjusting wheel 54 or adjusting wheel 56 will translate into an axial movement along shaft 44 due to the threaded engagement of the wheels 54, 56 with threaded end portions 46, 48. In such a manner, the mine alert device 1 can quickly, easily and accurately be positioned between the floor and ceiling of an underground mine shaft. Additionally, the amount of compression force visually indicated on gauge 24 can be watched by the installer, thereby automatically setting the proper gap 32.

Therefore, as will be understood from the discussion below, the compression force exerted upon cap assembly 10 translates into an axial movement of plunger 16 in oil filled chamber 20 and such compression force is axially supported via spreader 40 and support member 42. The mine alert device 1 can thus be easily transported to the underground mine and quickly assembled by merely positioning the three elements noted above and turning the adjusting wheels 54, 56 to adjust the visually indicated pressure on gauge 24 to reproduce a predetermined setting. In such a manner, the gap 32 between contacts 28, 30 will dependently be set thereby providing a set point for the actuation of alarm 36 upon a predetermined movement of the earth in the underground mine.

The gap 32 between contacts 28, 30 is preferably pre-established prior to installation of the device 1 in the manner described above. Since there exists a direct correlation between the visually indicated pressure on gauge 24 and the gap 32 between contacts 28, 30, gap 32 will necessarily determine the amount of earth movement required to actuate alarm 36. Therefore, a mining engineer or the like, will be able to determine the amount of earth movement that will present a hazard to the miners in the underground mine and, accordingly, will be able to select the proper setting for gap 32.

The gap setting 32 between contacts 28, 30 is preferably pre-established by utilizing a channel structure 60 having two upright rigid portions 62, 64 between which the device 1 can be longitudinally placed. As can be seen more clearly in FIG. 3, the channel member 60 is of sufficient longitudinal length such that the device 1 can be placed between the rigid upright portions 62, 64 with sufficient space remaining between the bottom of the body member 12 and upright portion 64. In the additional space between body member 12 and upright portion 64, there is provided a spacer block 66 of suitable material, such as, for example, wood, metal, or the like.

Attached to upright member 64 there is an adjusting mechanism 68 longitudinally aligned with the spacer block 66 and alert device 1. The adjusting mechanism preferably is a threaded shaft having an end impinging on the spacer block 66. In such a manner, the end of the adjusting mechanism 68 can be axially varied and, accordingly, when it is turned, a compression force is exerted upon cap member 10 by virtue of its positioning against rigid portion 62 thereby yieldably forcing plunger 16 to be depressed in fluid filled chamber 20. Thus, the adjusting mechanism can be turned until a predetermined gap 32 setting is achieved. The depression of plunger 16 in chamber 20 responsively causes a visual indication of gauge 24.

Gap 32 can be measured by suitable conventional means, such as, for example, feeler gauges or the like. When the desired gap 32 is obtained, the visual indication on gauge 24 is recorded such as, by physically marking the indication directly on gauge 24 with a mark or the like, or noting the indication directly on device 1 or on a separate log sheet. Device 1 can then be removed from the channel member 60 by reversally turning adjusting mechanism 68 and subsequently transported to the underground mine for installation.

When installing the alarm device 1, the person installing it merely needs to adjust the spreader 40 as discussed above until the visual indication on gauge 24 is the same as that which was previously noted when the gap 32 was pre-established. Thus, no special feeler gauges or the like need to be transported with the alert device 1 when it is being installed in the underground mine. Accordingly, once the spreader 40 is adjusted so that the noted visual indication is reproduced on gauge 24, it will correspondingly and accurately set the gap 32 between contacts 28 and 30 in the desired predetermined manner.

Referring again to FIG. 1, it is seen that cap assembly 10 defines a surface-engaging portion 14 for engaging the ceiling of a mine shaft. While cap assembly 10 is shown as a cylindrical cap, having a flat upper surface, it should be realized that any means can be satisfactorily utilized for engaging the ceiling in a mine shaft, although a relatively large surface is preferred. Additionally, cap assembly 10 defines a recess into which the upper portion of plunger 16 is retained. Spacers 18 can optionally be provided between the plunger 16 and the cap member 10 such that the length of the plunger 16 can be increased, thereby raising cap assembly 10 a predetermined distance above the body member 12.

The body member 12 generally defines a chamber 20 that can be of any size or shape so long as the lower portion of plunger 16 is slidably retained therein. Retaining plate 21 is provided to restrict the travel of plunger 16 at its uppermost limit. Chamber 20 preferably is filled with a predetermined volume of fluid, such as, for example, oil or the like. However, other compressible means such as a spring or a compressible medium of rubber or the like can be satisfactorily utilized. Around the circumference of the lower portion of plunger 16, there is preferably provided suitable sealing structures 22 such as, O-rings of rubber neoprene or the like. O-rings 22 are in contact with the walls of chamber 20 and function to seal fluid in chamber 20 such that movement of plunger 16 in chamber 20 will effect compression of the fluid therein.

Gauge 24 is operatively associated with the fluid filled chamber 20 by a suitable threaded nipple connection 25. In such a manner, gauge 24 can be in direct communication with the fluid in chamber 20 and is preferably of the type that will sense compression of the fluid in chamber 20 and give a direct visual indication on the face thereof. The visual indication is utilized by a person installing the device 1 to properly set gap 32. Thus, a precise and accurate setting can be achieved merely by adjusting the compression force indicated visually on gauge 24 until a predetermined indication is achieved. Thus, the necessity of measuring the gap 32 when device 1 is installed in the mine is completely obviated thereby enabling unskilled persons to install the device. As noted above, the predetermined visual indication correlating to a predetermined setting of gap 32 will be preferably pre-established by a skilled mine engineer or the like prior to installation in the mine shaft.

In the chamber 20 there may be provided a spring 26 for biasing the plunger 16 axially in chamber 20 in a direction opposed to the compression force. In such a manner, a compression force applied to the surface 14 of the cap assembly 10 will cause the plunger 16 to be yieldably depressed in the chamber 20 thereby compressing the fluid contained therein. Thus, a movement of cap assembly 10 under a compression force dependently causes the fluid contained in chamber 20 to be compressed and, as such, the compression pressure can be visually indicated on gauge 24.

An important aspect of the present invention is the capability thereof for warning miners of an impending collapse in the underground mine. The present invention contemplates that electrical contacts 28, 30 are opposingly disposed such that a gap 32 is defined therebetween.

Contacts 28, 30 are connected to an alarm system as schematically depicted in FIG. 1. Preferably, the alarm system comprises an alarm unit 36 and a source of power 38, such as a battery or the like. Thus, when gap 32 decreases such that contact 28 engages contact 30, the alarm circuit will be actuated. Various state of the art alarm units can be advantageously utilized according to the present invention and can be operated from either direct current (D.C.) or alternating current (A.C.) power. However, direct current (D.C.) is preferable when considering the remote placement of the alarm devices in a mine shaft. Accordingly, it is contemplated that the alarm circuit and the power source 38 can be in a self contained unit and mounted in close proximity or adjacent to the device according to the present invention.

Preferably, contacts 28, 30 are positioned relative to each other such that the electrical contact 28 is carried with cap member 10 while contact 30 is included in the upper portion of body member 12. Contacts 28 and 30 should be surrounded by a non-conducting material, such as bakelite, rubber or the like. In the embodiment depicted in FIG. 1, bakelite rings 33, 34 are respectively provided on the lower portion of cap assembly 10 and the upper portion of body member 12. Contacts 28, 30 surrounded by bakelite rings 33, 34, respectively, reduce the possibility of electrical short cicuiting of the alarm system.

As noted above, a compression force applied to cap assembly 10 by movement in the mine shaft ceiling will cause plunger 16 to be yieldably depressed in fluid filled chamber 20 thereby causing a visual indication on gauge 24. Additionally, the compression of plunger 16 in fluid filled chamber 20 will cause the distance between contacts 28, 30 to be decreased. Thus, gap 32 defined between contacts 28, 30 is directly correlated to the visual indication appearing on gauge 24 thereby enabling gap 32 to be accurately set merely by adjusting the visual indication on gauge 24 until the predetermined visual indication is reproduced.

While the present invention has been herein described in what is presently conceived to be the most practical and preferred embodiment thereof, it will be understood that those of ordinary skill in the art may appreciate many modifications which may be made thereof within the scope of the invention, which scope is to be accorded the broadest interpretation of the appended claims so as to encompass all equivalent assemblies and structures.

What I claim is:

1. A mine alert device comprising:

surface-engaging means for engaging at least one of a plurality of surfaces defining an underground mine;

means defining a chamber in which a compressible medium is enclosed;

a plunger connected between said surface-engaging means and said chamber-defining means, said plunger slidably engaged with said chamber at one end thereof in contact with said compressible medium therein so that said plunger moves in response to a compression force applied to said surface-engaging means and applies pressure on said compressible medium;

switch means for actuating an alarm in response to a predetermined amount of movement between said surface-engaging means and said chamber-defining means; and visual means operatively associated with said compressible medium for establishing said predetermined amount of movement between said surface-engaging means and said chamber defining means required for said switch means to actuate the alarm.

2. A device as in claim 1 further comprising biasing means for biasing said plunger in a direction opposite to said compression force.

3. A device as in claim 1 wherein said compressible medium is a fluid.

4. A device as in claim 3 wherein said fluid is oil.

5. A device as in claim 4 wherein said visual means comprises a pressure gauge.

6. A device as in claim 1 or 5 wherein said switch means includes first and second opposing contact means defining a predetermined gap therebetween for actuating said alarm, said gap decreasing from a predetermined set position to an alarm actuating position in response to predetermined earth movement in an underground mine.

7. A device as in claim 6 wherein said surface-engaging means includes said first contact means and said chamber-defining means includes said second contact means.

8. A mine alert device comprising:

a cap member having a surface-engaging portion adapted to engage at least one of a plurality of surfaces defining an underground mine;

a body member defining a chamber in which a predetermined volume of fluid is enclosed, a plunger connected between said cap member and said body member, said plunger slidably engaged with said chamber at one end thereof so that said plunger reciprocally moves in said chamber and applies force to said fluid in response to a compression force applied to said cap member;

biasing means for biasing said plunger in a direction opposite to said compression force;

switch means for actuating an alarm, said switch means including opposingly disposed first and second contacts defining a predetermined gap therebetween, said first contact being associated with said cap member and said second contact being associated with said body member, said gap decreasing from a predetermined set position to an alarm actuating position in response to said compression force so as to be determinable of a maximum predetermined amount of earth movement; and visual means operatively associated with said fluid for establishing said predetermined gap set position.

9. A device as in claim 8 further comprising support means for supporting said device between the floor and ceiling of an underground mine such that said surface-engaging portion engages said ceiling.

10. A device as in claim 9 further comprising adjusting means for adjustably displacing said plunger in said cavity to responsively adjustably apply force to said fluid enclosed therein.

11. A device as in claim 9 wherein said body member further includes at the end opposite said cap member and axially aligned therewith, means defining a cavity for accepting a portion of said support means so that said supporting means and said body member are in axial alignment.

12. A device as in claim 10 wherein said adjusting means comprises an elongated central member having first and second threaded end portions, said central member being disposed between said body member and said support means in axial alignment therewith, and first and second turning members each defining a threaded female cavity for respective threaded engagement with said first and second end portions, said first turning member including means defining a first force-bearing surface in contact with the bottom portion of said body member and said second turning member including means defining a second force-bearing surface in contact with the top portion of said support means so that a turning movement of either said first or second turning members will effect a responsive displacement of said plunger in said cavity.

13. A device as in claim 8 further comprising alarm means operatively connected to said first and second contacts for alarming persons of earth movement in an underground mine when said first and second contacts are in said alarm actuating position.

14. A mine alert device adapted to being axially positioned between two opposing earth surfaces in an undrground mine to warn miners of dangerous earth movement of at least one of said surfaces, said device comprising:

a cap member having a surface-engaging portion and a bottom surface portion defining a first recessed portion;

a body member having first and second ends and defining a chamber in which a predetermined volume of fluid is enclosed, said first end being opposingly disposed to said bottom surface portion of said cap member and said second and defining a second recessed portion;

a plunger cooperating at one end with said first recessed portion of said cap member and slidably engaged with said chamber at the opposite end thereof so that said plunger axially and reciprocally moves in said chamber and applies force to said fluid in response to a compression force applied to said cap member;

spring means for biasing said plunger in a direction opposite to said compression force;

alarm means for alarming miners of earth movement in an underground mine;

switch means operatively connected to said alarm means for actuating said alarm means, said switch means including opposingly disposed first and second contacts defining a predetermined gap therebetween, said first contact being associated with said bottom surface portion of said cap member and said second contact being associated with said first end of said body member, said gap decreasing from a predetermined set position to an alarm actuating position in response to a predetermined amount of earth movement necessary to actuate said alarm means; and visual means operatively associated with said fluid for displaying the force applied to said fluid in response to displacement of said plunger in said cavity and for establishing said gap and thus establishing said predetermined amount of earth movement required for said switch means to actuate said alarm means;

a supporting portion including;

an elongated supporting member having first and second supporting end portions, said first supporting end defining an elongated supporting cavity; and adjusting means for adjustably displacing said plunger in said cavity to responsively adjustably apply force to said fluid enclosed therein, said adjusting means including an elongated central shaft having first and second male threaded end portions, and first and second turning members each defining a female threaded cavity for respective threading engagement with said first and second male threaded end portions, said first turning member including means defining a first force-bearing surface in contact with said second end of said body member and said second turning member including means defining a second force-bearing surface in contact with said first supporting end of said supporting member, said first and second threaded male end portions being respectively accepted in said second recessed portion and said supporting cavity, so that a turning movement of either of said first or second turning members will effect a responsive displacement of said plunger in said cavity.

15. A method of installing a mine alert device of the type including a piston reciprocally moveable in a cavity to apply force upon a compressible medium contained therein, switch means defining a gap for actuating an alarm in response to a predetermined amount of earth movement in an underground mine, and visual means for setting said switch means, said method comprising the steps of:

(a) pre-establishing the set position of said switch means corresponding to a predetermined amount of earth movement by measuring the gap with a gap measuring tool while referring to a visual indication appearing on the visual means which visual indication corresponds to the gap measured by the gap measuring tool;

(b) installing the device between two opposing surfaces in an underground mine; and (c) reproducing the visual indication appearing on the visual means obtained in step (a) by adjusting the relative movement of the piston in the cavity to set the switch means in the predetermined set position.

16. A method as in claim 15 wherein step (a) is practiced by:

(i) adjusting the compression force exerted upon the device;

(ii) measuring the gap;

(iii) repeating steps (i)-(ii) until a predetermined gap setting is achieved; and (iv) noting the indication appearing on the visual means corresponding to the predetermined gap setting.

* * * * *